US012571114B2

(12) United States Patent
Baumann et al.

(10) Patent No.: US 12,571,114 B2
(45) Date of Patent: Mar. 10, 2026

(54) ELECTROCHEMICAL OXIDATION OF CYCLOALKANES TO FORM CYCLOALKANONE COMPOUNDS

(71) Applicant: Evonik Operations GmbH, Essen (DE)

(72) Inventors: Franz-Erich Baumann, Duelmen (DE); Frank Weinelt, Billerbeck (DE); Siegfried R. Waldvogel, Gau-Algesheim (DE); Anna-Lisa Rauen, Mainz (DE); Joachim Nikl, Frankfurt am Main (DE)

(73) Assignee: Evonik Operations GmbH, Essen (DE)

( * ) Notice: Subject to any disclaimer, the term of this patent is extended or adjusted under 35 U.S.C. 154(b) by 0 days.

(21) Appl. No.: 18/850,115

(22) PCT Filed: Mar. 22, 2023

(86) PCT No.: PCT/EP2023/057342
§ 371 (c)(1),
(2) Date: Sep. 24, 2024

(87) PCT Pub. No.: WO2023/186659
PCT Pub. Date: Oct. 5, 2023

(65) Prior Publication Data

US 2025/0215583 A1 Jul. 3, 2025

(30) Foreign Application Priority Data

Mar. 28, 2022 (EP) ..... 22164767

(51) Int. Cl.
*C25B 3/07* (2021.01)
*C25B 3/23* (2021.01)
*C25B 9/17* (2021.01)
*C25B 11/043* (2021.01)

(52) U.S. Cl.
CPC ..... *C25B 3/07* (2021.01); *C25B 3/23* (2021.01); *C25B 9/17* (2021.01); *C25B 11/043* (2021.01)

(58) Field of Classification Search
CPC ..... C25B 3/07; C25B 3/23
USPC ..... 205/446, 447
See application file for complete search history.

(56) References Cited

U.S. PATENT DOCUMENTS

| | | | | |
|---|---|---|---|---|
| 11,976,373 | B2 | 5/2024 | Weinelt et al. | |
| 2003/0029733 | A1 * | 2/2003 | Otsuka | C25B 5/00 204/252 |
| 2023/0212762 | A1 | 7/2023 | Weinelt et al. | |
| 2025/0109509 | A1 | 4/2025 | Weinelt et al. | |
| 2025/0215584 | A1 | 7/2025 | Weinelt et al. | |
| 2025/0223709 | A1 | 7/2025 | Weinelt et al. | |

FOREIGN PATENT DOCUMENTS

| | | | | |
|---|---|---|---|---|
| CN | 104032327 | | 6/2016 | |
| EP | 0 548 141 | | 4/1992 | |
| JP | 2019-99861 | | 6/2019 | |
| JP | 2019099861 | A * | 6/2019 | C07C 35/08 |
| WO | 92/05299 | | 4/1992 | |
| WO | 2021/260679 | | 12/2021 | |

OTHER PUBLICATIONS

Balavoine et al., "Functionalisation of Saturated Hydrocarbons. Part X.1 A Comparative Study of Chemical and Electrochemical Processes (GIF and GIF-Orsay Systems) in Pyridine in Acetone and in Pyridine-Co-Solvent Mixtures," Tetrahedron (Jan. 1, 1988), vol. 44, No. 4, pp. 1091-1106. (Year: 1988).*

European Search Report received for European Patent Application No. 22164767.0, mailed on Nov. 17, 2022, 8 pages.

Gütz et al., "Electrochemical Screening for Electroorganic Synthesis", Org. Process Res. Dev., vol. 20, 2016, pp. 26-32.

International Search Report received for PCT Application No. PCT/EP2023/057342, mailed on Jul. 17, 2023, 8 pages, with English translation.

Kawamata et al., "Scalable, Electrochemical Oxidation of Unactivated C—H Bonds", J. Am. Chem. Soc., vol. 139, May 16, 2017, pp. 7448-7551.

Kirste et al., "Anodic Phenol-Arene Cross-Coupling Reaction on Boron-Doped Diamond Electrodes", Angew. Chem. Int. Ed., vol. 49, 122, 2010, 10 pages, with English translation.

Written Opinion received for PCT Application No. PCT/EP2023/057342, mailed on Jul. 17, 2023, 11 pages, with English translation.

Yamanaka et al., "Oxidation of alkanes with $H_2O$ on $Ir(acac)_3$ supported on a carbon fiber-anode", Chem. Commun., Oct. 31, 2000, pp. 2209-2210.

U.S. Pat. No. 11,976,373, May 7, 2024, 2023/0212762, Weinelt et al.

U.S. Appl. No. 18/851,145, filed Sep. 26, 2024, 2025/0215584, Weinelt et al.

U.S. Appl. No. 18/849,121, filed Sep. 20, 2024, 2025/0109509, Weinelt et al.

U.S. Appl. No. 18/849,610, filed Sep. 23, 2024, 2025/0223709, Weinelt et al.

* cited by examiner

*Primary Examiner* — Edna Wong
(74) *Attorney, Agent, or Firm* — Grüneberg Global IP, PLLC

(57) ABSTRACT

A process produces unsubstituted or at least singly substituted cycloalkanones by electrochemical oxidation of unsubstituted or at least singly substituted, saturated cycloaliphatic hydrocarbons in the presence of an inorganic or organic nitrate salt in an electrolysis cell in a reaction medium in the presence of oxygen.

48 Claims, No Drawings

ELECTROCHEMICAL OXIDATION OF CYCLOALKANES TO FORM CYCLOALKANONE COMPOUNDS

CROSS-REFERENCE TO RELATED APPLICATIONS

This application is a National Stage entry under § 371 of International Application No. PCT/EP2023/057342, filed on Mar. 22, 2023, and which claims the benefit of priority to European Patent Application No. 22164767.0, filed on Mar. 28, 2022. The content of each of these applications is hereby incorporated by reference in its entirety.

BACKGROUND OF THE INVENTION

Field of the Invention

The invention relates to a process for producing unsubstituted or at least singly substituted cycloalkanones by electrochemical oxidation of unsubstituted or at least singly substituted, saturated cycloaliphatic hydrocarbons in the presence of an inorganic or organic nitrate salt in an electrolysis cell in a reaction medium in the presence of oxygen.

Cycloalkanone and cycloalkanol compounds are important intermediates in a large number of industrial production processes. The oxidation of saturated, non-functionalized cycloaliphatic hydrocarbons (and thus non-activated C—H bonds) to corresponding ketones or alcohols requires particular reaction conditions in order that these unreactive substances are selectively converted into monofunctional successor products while preserving the ring structure.

Description of Related Art

There is a range of processes based on transition metal-catalysed reactions and oxygen or on the use of chemical oxidants such as peroxides. The use of costly transition metals and of chemical oxidants results not only in increased costs but also in reagent wastes that sometimes necessitate laborious disposal.

One such example is the production of polyamide 12 from laurolactam, which nowadays proceeds primarily via cyclododecanone as intermediate. This is initially converted into the peroxide by air. In order to ensure a largely selective further reaction, boron oxide is used, which reacts with the peroxide to form boric esters and oxygen. The resulting alcohol is then oxidized to cyclododecanone on the CuCr catalyst. The disadvantage of this reaction pathway consists primarily of the use of boron oxide, which is now being discussed as a substance of particular interest, since it is suspected of affecting fertility and harming the unborn child.

The publication by Yamanaka (J. Chem. Commun. 2000, 2209-2210) reports that the anodic oxidation of alkanes in aqueous medium leads to $CO_2$ at low current densities of <0.1 mA/cm$^2$. In non-aqueous media, the oxidation of adamantane is observed at voltages of >2 V and current densities of <4 mA/cm$^2$, with oxygen activation taking place at the cathode. It has been shown that the rate of formation of cycloaliphatic ketones (cyclohexanone) and the current yield are increased considerably by an $Ir(acac)_2$/carbon fibre anode in particular. The oxygen here originates from water. Organic solvents have an influence, for instance no conversion of cyclohexane takes place in acetonitrile.

The publication by Kawamata (J. Am. Chem. Soc. 2017 (139), 7448-7551) showed that the electrochemical oxidation of unactivated C—H bonds in functionalized aliphatic and cycloaliphatic species at low potentials is possible when a mediator, for example quinuclidine (tertiary amine, toxic) is used in combination with HFIP (hexafluoroisopropanol, causes organ damage, teratogenic). The conducting salt used was $Me_4N—BF_4$. It was established that the oxygen introduced originated from the gas phase. No reaction took place under argon.

SUMMARY OF THE INVENTION

It is an object of the invention to provide a sustainable and resource-conserving process that converts unsubstituted or at least singly substituted, saturated cycloaliphatic hydrocarbons as selectively as possible into the corresponding ketones as the principal products.

This object was achieved by the subject-matter of the embodiments and by the description herein.

The present invention relates to a process for producing unsubstituted or at least singly substituted cycloalkanones by electrochemical oxidation of unsubstituted or at least singly substituted, saturated cycloaliphatic hydrocarbons, comprising the process steps of (a) providing at least one unsubstituted or at least singly substituted, saturated cycloaliphatic hydrocarbon;
(b) providing at least one organic nitrate salt;
(c) electrochemically oxidizing the unsubstituted or at least singly substituted, saturated cycloaliphatic hydrocarbon provided in step (a) in the presence of the organic nitrate salt provided in step (b) in an electrolysis cell in a reaction medium in the presence of oxygen.

The process of the invention has the particular features of high selectivity, small amounts of auxiliary chemicals used, the use of electric current as oxidizing agent and, associated therewith, the generation of smaller amounts of waste products.

It was surprisingly found that, with the aid of the electrochemical oxidation process according to the invention, it is possible to use the oxygen in air for introduction of the oxygen function into cycloaliphatic hydrocarbons. This makes it possible to dispense with the use of chemical oxidants such as reactive peroxides and costly catalysts with complex ligand systems. At the same time, the use of toxic and/or potentially carcinogenic reagents can be reduced or even avoided altogether. The method that has been developed represents an inexpensive and environmentally friendly alternative to existing syntheses. The simple and safe process conditions make it possible to produce large amounts of the desired compounds without great outlay. The present invention thus allows previously cost- and time-intensive processes to be substantially optimized.

It was also surprisingly found that the process according to the invention makes it possible to use electric current to produce cycloalkanone compounds from unsubstituted cycloalkanes with the use of nitrate salts, which act both as conducting salt and as electrochemical mediator. If by-products, especially cycloaliphatic alcohols of the same ring size, occur during the performance of the process according to the invention, this is unproblematic, since they can be converted into the corresponding ketones by already-established further processes.

It was additionally surprisingly found that the process according to the invention can be carried out at ambient pressure and ambient temperature, which is likewise advantageous for energy efficiency and thus for environmental compatibility too.

DETAILED DESCRIPTION OF THE INVENTION

In the process according to the invention it is possible to use unsubstituted or at least singly substituted, saturated cycloaliphatic hydrocarbons that are monocyclic or polycyclic. Preferential consideration is given to monocyclic or bicyclic cycloaliphatic hydrocarbons. Particular preference is given to using monocyclic cycloaliphatic hydrocarbons in the process according to the invention.

Preferably, the monocyclic or polycyclic, especially monocyclic or bicyclic, saturated cycloaliphatic hydrocarbons used in the process according to the invention may have 5 to 18 carbon atoms in the ring system. These cycloaliphatic hydrocarbons may each be unsubstituted or they may be singly or multiply substituted. Where they are singly or multiply substituted, they are preferably substituted with 1, 2, 3, 4 or 5 substituents, each independently selected from the group consisting of methyl, phenyl or benzyl. The phenyl or benzyl substituents may themselves each be unsubstituted or singly or multiply substituted with 1, 2 or 3 substituents, each independently selected from the group consisting of F, Cl, Br and $NO_2$. Where the cycloaliphatic hydrocarbons used according to the invention or substituents thereof contain alkyl radicals having more than one carbon atom in the side chain, the performance of the process according to the invention can result in the occurrence of undesired side reactions in these substituents.

Particular preference is given to using in the process according to the invention, as unsubstituted or at least singly substituted, saturated cycloaliphatic hydrocarbons, monocyclic saturated hydrocarbons having 6 to 12 carbon atoms in the ring, preferably having 8 to 12 carbon atoms in the ring, that are unsubstituted or singly or multiply substituted with 1, 2, 3, 4 or 5 substituents, each independently selected from the group consisting of methyl, phenyl or benzyl. Very particular preference is given to using in the process according to the invention monocyclic saturated hydrocarbons having 8 to 12 carbon atoms in the ring that are unsubstituted or singly or doubly or triply substituted with a methyl group.

Very particularly preferably, the saturated monocyclic hydrocarbon is unsubstituted and selected from the group consisting of cyclohexane, cycloheptane, cyclooctane, cyclononane, cyclodecane, cycloundecane and cyclododecane, even more preferably selected from the group consisting of cyclooctane, cyclononane, cyclodecane, cycloundecane and cyclododecane, most preferably the hydrocarbon is cyclododecane.

According to step (b) of the process according to the invention, at least one organic nitrate salt is provided. This nitrate salt functions both as the conducting salt and as the mediator of the electrochemical oxidation process according to the invention. Preference is given to using an organic nitrate of the general formula $$[\text{cation}^+][NO_3^-]$$

where the [cation$^+$] is selected from the group consisting of ammonium ions having the general structure $[R^1R^2R^3R^4N^+]$ where $R^1$, $R^2$, $R^3$ and $R^4$ are each independently selected from the group consisting of $C_1$ to $C_{16}$ alkyl, especially $C_1$ to $C_8$ alkyl, straight-chain or branched, imidazolium cations of the general structure (I)

(I)

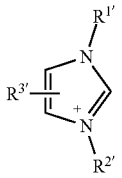

where $R^{1'}$ and $R^{2'}$ are each independently selected from the group consisting of $C_1$ to $C_{18}$ alkyl, straight-chain or branched, especially $C_1$ to $C_8$ alkyl, straight-chain or branched, and $R^{3'}$ is selected from the group consisting of H and $C_1$ to $C_{18}$ alkyl, straight-chain or branched, especially from the group consisting of H and $C_1$ to $C_8$ alkyl, straight-chain or branched, pyridinium cations of the general structure (II)

(II)

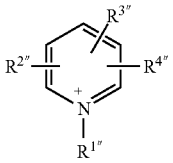

where $R^{1''}$ is selected from the group consisting of $C_1$ to $C_{18}$ alkyl, especially $C_1$ to $C_8$ alkyl, straight-chain or branched, and $R^{2''}$, $R^{3''}$ and $R^{4''}$ are each independently selected from the group consisting of H and $C_1$ to $C_{18}$ alkyl, straight-chain or branched, especially from the group consisting of H and $C_1$ to $C_8$ alkyl, straight-chain or branched, and phosphonium ions having the general structure $[R^{1a}R^{2a}R^{3a}R^{4a}P^+]$ where $R^{1a}$, $R^{2a}$, $R^{3a}$, $R^{4a}$ are each independently selected from the group consisting of $C_1$ to $C_{16}$ alkyl, especially $C_1$ to $C_8$ alkyl, straight-chain or branched.

Where an organic nitrate based on imidazolium cations is used in the process according to the invention, preference is given to cations of the general formula (I) in which $R^{1'}$ and $R^{2'}$ are each independently selected from the group consisting of $C_1$ to $C_{18}$ alkyl, straight-chain or branched, especially $C_1$ to $C_8$ alkyl, straight-chain or branched and $R^{3'}$ is hydrogen. Particularly preferred are imidazolium cations of the general formula (I) in which $R^{1'}$ is methyl and $R^{2'}$ is ethyl or $R^{1'}$ is methyl and $R^{2'}$ is methyl or $R^{1'}$ is methyl and $R^{2'}$ is butyl, and $R^{3'}$ is in each case hydrogen.

Where a nitrate based on pyridinium cations is used in the process according to the invention, preference is given to cations of the general formula (II) in which $R^{1''}$ is $C_1$ to $C_{18}$ alkyl, straight-chain or branched, especially $C_1$ to $C_8$ alkyl, straight-chain or branched. Particularly preferred are pyridinium cations of the general formula (II) in which $R^{1'}$ is $C_1$ to $C_{18}$ alkyl, straight-chain or branched, especially $C_1$ to $C_8$ alkyl, straight-chain or branched, and the radicals $R^{2'}$, $R^{3'}$ and $R^{4'}$ are each independently selected from the group consisting of $C_1$ to $C_8$ alkyl, straight-chain or branched, preference being given to single substitution in the 2-, 3- or 4-position, double substitution in the 2,4-, 2,5- or 2,6-position or triple substitution in the 2,4,6-position.

It is in principle also possible to use two or more of the abovementioned nitrate salts in the process according to the invention. Preference is given to using a nitrate salt according to the invention, especially an organic ammonium nitrate salt of composition $[R^1R^2R^3R^4N^+][NO_3^-]$ or an organic phosphonium salt of composition $[R^{1a}R^{2a}R^{3a}R^{4a}P^+][NO_3^-]$, particular preference being given to an organic ammonium nitrate salt of composition $[R^1R^2R^3R^4N^+][NO_3^-]$.

Very particularly preferably, the organic ammonium nitrate salt is tetra-n-butylammonium nitrate or methyltri-n-octylammonium nitrate. The organic phosphonium nitrate salt is very particularly preferably tetra-n-butylphosphonium nitrate or methyltri-n-octylphosphonium nitrate. The organic imidazolium nitrate salt is preferably 1-butyl-3-methylimidazolium nitrate.

Most preferably, the organic nitrate salt used in the process according to the invention is tetra-n-butylammonium nitrate or methyltri-n-octylammonium nitrate.

The order in which the components used in the process according to the invention are provided may vary, as can the order in which the individual components are brought into contact with each other or with the respective reaction medium.

In one embodiment of the process according to the invention, the unsubstituted or at least singly substituted, saturated cycloaliphatic hydrocarbon or the organic nitrate salt is initially charged and brought together with the reaction medium, preferably at least partially or completely dissolved in the reaction medium or mixed therewith, and then the other components each added to these two components. In another embodiment of the process according to the invention, the unsubstituted or at least singly substituted, saturated cycloaliphatic hydrocarbon and the organic nitrate salt are initially charged and then brought together with the reaction medium and preferably at least partially or completely dissolved in the reaction medium or mixed therewith. It is also possible that in the process according to the invention the unsubstituted or at least singly substituted, saturated cycloaliphatic hydrocarbon and the inorganic or organic nitrate salt are added to the reaction medium at the same time or one after the other and preferably at least partially or completely dissolved in the reaction medium or mixed therewith.

The reaction medium used in the process according to the invention is liquid under the conditions under which the process is carried out and is capable of partially or completely dissolving the components used, i.e. especially the unsubstituted or at least singly substituted, saturated cycloaliphatic hydrocarbon and the inorganic or organic nitrate salt. Where at least one of these components is used in liquid form, the reaction medium is preferably readily miscible with said component(s).

In the process according to the invention, preference is given to using a polar aprotic reaction medium for the electrochemical oxidation. This may be used in anhydrous form, in dried form or else in combination with water.

Where an inorganic nitrate salt, especially potassium nitrate or sodium nitrate, is used in the process according to the invention, the reaction medium advantageously contains water, preference being given to an aprotic reaction medium in combination with water. The water content in the reaction medium may vary. The water content is preferably up to 20% by volume, more preferably up to 15% by volume, especially preferably up to 10% by volume, even more preferably up to 5% by volume, in each case based on the total amount of reaction medium.

Preferably, the polar aprotic reaction medium is selected from the group consisting of aliphatic nitriles, aliphatic ketones, cycloaliphatic ketones, dialkyl carbonates, cyclic carbonates, lactones, aliphatic nitroalkanes, dimethyl sulfoxide, esters and ethers, or a combination of at least two of these components.

Particularly preferably, the reaction medium is selected from the group consisting of acetonitrile, isobutyronitrile, adiponitrile, acetone, dimethyl carbonate, methyl ethyl ketone, 3-pentanone, cyclohexanone, nitromethane, nitropropane, tert-butyl methyl ether, dimethyl sulfoxide, gamma-butyrolactone and epsilon-caprolactone or a combination of at least two of these components.

Very particularly preferably, the reaction medium is selected from the group consisting of acetonitrile, isobutyronitrile, adiponitrile, dimethyl carbonate and acetone or a combination of at least two of these components.

Very particularly preferably, the reaction medium is acetonitrile, isobutyronitrile or adiponitrile in dried or anhydrous form.

Likewise very particularly preferably, the reaction medium is acetonitrile, isobutyronitrile or adiponitrile, optionally in combination with water.

Where one or more of the abovementioned components is used in the reaction medium in combination with water, the water content is preferably up to 20% by volume, more preferably up to 15% by volume, especially preferably up to 10% by volume, even more preferably up to 5% by volume, in each case based on the total amount of reaction medium.

For the performance of the process according to the invention it may be advantageous to add further solubilizing components to the reaction medium. Suitable advantageous components may be identified through simple preliminary tests of dissolution behaviour.

Examples of solubilizing components are primary alcohols, secondary alcohols, monoketones or dialkyl carbonates or mixtures of at least two of these components, optionally in combination with water. Preference is given to using aliphatic $C_1$-6 alcohols in the process according to the invention; particularly preferred solubilizing components can be selected from the group consisting of methanol, ethanol, isopropanol, 2-methyl-2-butanol or mixtures of at least two of these components, optionally in combination with water.

It may be especially advantageous to use as reaction medium dimethyl carbonate, optionally in combination with at least one $C_{1-6}$ alcohol selected in particular from the group consisting of methanol, ethanol, isopropanol, 2-methyl-2-butanol, optionally in combination with water.

Where one or more of these solubilizing components is used in combination with water, the water content is preferably up to 20% by volume, more preferably up to 15% by volume, especially preferably up to 10% by volume, even more preferably up to 5% by volume, in each case based on the total amount of solubilizing component and water The solubilizing components may be added in amounts of preferably <50% by volume, more preferably of <30% by volume, especially preferably of <10% by volume, in each case based on the total amount of reaction medium.

Preferably, the organic nitrate salt is used in the process according to the invention in an amount of 0.1 to 2.0, preferably 0.2 to 1.0, more preferably 0.3 to 0.8 and especially preferably 0.4 to 0.8, equivalents, in each case based on the amount of unsubstituted or at least singly substituted, saturated cycloaliphatic hydrocarbon.

According to the invention, the electrochemical oxidation of the unsubstituted or at least singly substituted, saturated cycloaliphatic hydrocarbon in the presence of the inorganic or organic nitrate salt takes place in an electrolysis cell in a reaction medium in the presence of oxygen.

It is advantageous when an oxygen-containing gas atmosphere that is in spatial communication with the reaction medium is provided.

The proportion of oxygen in the gas atmosphere may vary. Preferably, the proportion of oxygen in the gas atmosphere is 10% to 100% by volume, more preferably 15% to 30% by volume, more preferably 15% to 25% by volume, especially preferably 18% to 22% by volume.

In one embodiment, the proportion of oxygen in the gas atmosphere may be 10% to 100% by volume, more preferably 15% to 100% by volume, more preferably 20% to 100% by volume.

Very particularly preferably, the gas atmosphere is air.

It is advantageous when gas exchange is forced between the gas atmosphere and the reaction medium, preferably by introducing the gas atmosphere into the reaction medium or by stirring the liquid phase in the presence of the gas atmosphere.

The gas exchange between the gas atmosphere and the reaction medium, especially the stirring, can be used to control the electrochemical oxidation, for example via the geometry of the stirrer or the stirrer speed.

Preferably, the amount of oxygen dissolved in the reaction medium is at least 1 mmol/L reaction medium, more preferably at least 5 mmol/L reaction medium.

Likewise preferably, the amount of oxygen dissolved in the reaction medium is at least 10 mmol/L reaction medium.

The process according to the invention for producing unsubstituted or at least singly substituted cycloalkanones by electrochemical oxidation of unsubstituted or at least singly substituted, saturated cycloaliphatic hydrocarbons in the presence of an inorganic or organic nitrate salt in a reaction medium in the presence of oxygen can be carried out both in a divided electrolysis cell or else in an undivided electrolysis cell, preference being given to carrying it out in an undivided electrolysis cell.

To avoid undesired chemical reactions, it can be advantageous to separate the cathode compartment and anode compartment and to allow the exchange of charge between the anode compartment and cathode compartment to take place only through a porous diaphragm, commonly an ion-exchange resin.

The undivided electrolysis cell preferably used according to the invention has at least two electrodes. Anodes and cathodes made of customary materials may be used for this purpose, for example ones made of glassy carbon, boron-doped diamond (BDD) or graphite. The use of glassy carbon electrodes is preferred.

Preferably, the undivided electrolysis cell has at least one glassy carbon anode or at least one glassy carbon cathode. Preferably, both the anode and the cathode are glassy carbon electrodes.

The distance between the electrodes may vary over a certain range. Preferably, the distance is 0.1 mm to 2.0 cm, more preferably 0.1 mm to 1.0 cm, more preferably 0.1 mm to 0.5 cm.

In addition, the process according to the invention may be carried out batchwise or continuously, preferably in an undivided flow-through electrolysis cell.

Preferably, the process according to the invention is carried out with an amount of charge of 190 C (2 F) to 970 C (10 F), more preferably 320 C to 820 C, especially preferably 350 C to 800 C, even more preferably 380 C to 775 C, most preferably 380 C to 450 C, in each case based on 1 mmol of unsubstituted or at least singly substituted, saturated cycloaliphatic hydrocarbon.

Preferably, the electrochemical oxidation in the process according to the invention is carried out at a constant current.

The current density at which the process according to the invention is carried out is preferably at least 5 mA/cm$^2$ or at least 10 mA/cm$^2$ or at least 15 mA/cm$^2$ or at least 20 mA/cm$^2$, or 20 mA/cm$^2$ to 50 mA/cm$^2$, where the stated surface area refers to the geometric area of the electrodes.

An important advantage of the process according to the invention is that electric current is used as oxidant, which represents a particularly environmentally friendly agent when it comes from renewable sources, i.e. from biomass, solar thermal energy, geothermal energy, hydropower, wind power or photovoltaics in particular.

The process according to the invention can be carried out over a wide temperature range, for example at a temperature within a range of from 0 to 60° C., preferably from 5 to 50° C., more preferably 10 to 40° C., especially preferably 15 to 30° C.

The process according to the invention may be carried out at elevated or reduced pressure. Where the process according to the invention is carried out at elevated pressure, a pressure of up to 16 bar is preferred and a pressure of up to 6 bar particularly preferred.

Likewise preferably, the process according to the invention may be carried out at atmospheric pressure.

The products produced by the process according to the invention may be isolated and purified by customary processes known to those skilled in the art, especially by extraction, crystallization, centrifugation, precipitation, distillation, evaporation or chromatography.

The following examples further elucidate the present invention but are not intended to limit the scope of the invention.

General Information and Methods

Chemicals of analytical quality were obtained from the usual suppliers (such as TCI, Aldrich and Acros) and used. The oxygen was obtained in 2.5 quality from Nippon Gases Deutschland GmbH, Düsseldorf, Germany and used as is.

The electrode material used was glassy carbon (Sigradur® G, from HTW Hochtemperatur Werkstoffe GmbH, Thierhaupten, Germany).

High-performance liquid chromatography was carried out on a Shimadzu HPLC-MS with a SIL 20A HT autosampler, a CTO-20AC column oven, two LC-20AD pump modules for adjusting the eluent gradient, a SPD-M20A diode array detector, a CBM-20A system controller and a Eurospher II 100-5 C18 column (150×4 mm, Knauer, Berlin). Eluent: Acetonitrile/water/formic acid (1% by volume) (from 10% ACN to 90% ACN in 10 min+10 min 100% ACN). Mass spectrometric measurements were carried out on a LCMS-2020 from Shimadzu, Japan.

1H-NMR and 13C-NMR spectra were recorded at 25° C. with a Bruker Avance II 400 (400 MHZ, 5 mm BBFO probe with Z-gradient and ATM, SampleXPress 60 autosampler, Analytische Messtechnik, Karlsruhe, Germany).

The undivided Teflon cells used for the electrolysis are described in the literature (a) C. Gütz, B. Klöckner, S. R. Waldvogel, Org. Process Res. Dev. 2016, 20, 26-32; b) A. Kirste, G. Schnakenburg, F. Stecker, A. Fischer, S. R. Waldvogel, Angew. Chem. Int. Ed. 2010, 49, 971-975; Angew. Chem. 2010, 122, 983-987. (see SI).) The full range of these cells with stainless steel block is also commercially available as IKA Screening System (IKA-Werke GmbH & Co. KG, Staufen, Germany). The electrode dimensions were 3 cm×1 cm×0.3 cm.

Gases were introduced in a controlled manner via two model 5850S mass-flow controllers (MFCs) from Brooks Instrument B.V., Veenendaal, The Netherlands. This was done using one controller for the introduction of oxygen and one for the introduction of nitrogen. The controllers were controlled by means of Smart DDE and Matlab R2017b software. Volume flows were additionally monitored via a DK800 float-principle flowmeter from Krohne Messtechnik GmbH, Duisburg. For all experiments carried out, the overall volume flow was a constant 20 mL/min, which, limited by the MFCs used, also represents the maximum achievable volume flow. The percent volume flows of the two gases were adjusted using the MFCs and associated software. Gas cylinders from the following suppliers were used: Oxygen 2.5 from Nippon Gases Deutschland GmbH, Düsseldorf, and nitrogen 4.8 from Westfalen AG, Münster or nitrogen 5.0 from Nippon Gases Deutschland GmbH, Düsseldorf. The apparatus was for this purpose equipped with a gas distributor including gas adapter and also a Teflon lid for the electrolysis cells General Procedure GP1

An undivided electrolysis cell (100 mL three-necked round-bottomed flask, NS29 Teflon stopper with electrode holders, magnetic stirrer bar) was charged with the cycloalkane (5.0 mmol) and tetrabutylammonium nitrate (0.5 equiv.) and this was dissolved in acetonitrile (25 mL). The cell was equipped with glassy carbon electrodes (3 cm×1 cm×0.3 cm), which were 0.5 cm apart. The immersed surface area of the electrodes was 1.3 $cm^2$. Oxygen was optionally introduced into the gas space of the reaction vessel via an NS14.5 gas-inlet adapter. A galvanostatic electrolysis was carried out at 20 to 30° C. at a current density of 10 $mA/cm^2$.

After applying an amount of charge of 4 to 5 F (1930 C to 2412 C) in respect of the cycloalkane, the solvent together with the unreacted fraction of the cycloalkane were removed by distillation under reduced pressure. The residue was taken up in cyclohexane and water (20 mL each). After phase separation, the aqueous phase was extracted with cyclohexane (20 mL). The organic phases were combined, dried over sodium sulfate or magnesium sulfate, and the solvent was removed by distillation under reduced pressure. The product was left behind as the residue from this distillation.

EXAMPLE 1

Preparation of Cyclohexanone:

In accordance with GP1, cyclohexane (0.421 g, 5.0 mmol, 1.0 equiv.) was dissolved in acetonitrile (25 mL) and subjected to galvanostatic electrolysis at 25° C. under an oxygen atmosphere with application of 5 F. After workup according to GP1, the product was obtained as a colourless liquid (yield: 6%, 30 mg, 0.31 mmol). $^1H$ NMR (400 MHZ, $CDCl_3$) δ [ppm]=2.36-2.32 (m, 4H), 1.90-1.84 (m, 4H), 1.75-1.70 (m, 2H). The analytical data are in agreement with the literature values. For the determination of the yield, any solvent signals present were deducted from the calculation via integral ratios.

EXAMPLE 2

Preparation of Cycloheptanone:

In accordance with GP1, cycloheptane (0.491 g, 5.0 mmol, 1.0 equiv.) was dissolved in acetonitrile (25 mL) and subjected to galvanostatic electrolysis at 21° C. under an ambient air atmosphere with application of 4 F. Immersed surface area of electrodes: 1.5 $cm^2$. The solvent was then removed by distillation under reduced pressure and the residue purified by column chromatography (cyclohexane/ethyl acetate=10:0 to 7:3). After removal of the solvent by distillation, the product was obtained as a colourless liquid (yield: 20%, 0.112 g, 1.00 mmol). $^1H$ NMR (400 MHZ, $CDCl_3$) δ [ppm]=2.49-2.47 (m, 4H), 1.69-1.64 (m, 8H). The analytical data are in agreement with the literature values.

EXAMPLE 3

Preparation of Cyclooctanone:

In accordance with GP1, cyclooctane (0.561 g, 5.0 mmol, 1.0 equiv.) was dissolved in acetonitrile (25 mL) and subjected to galvanostatic electrolysis at 30° C. under an oxygen atmosphere with application of 4 F. After workup according to GP1, the product was obtained as a colourless liquid (yield: 42%, 0.261 g, 2.07 mmol). Rf (cyclohexane/ethyl acetate=7:3): 0.66; $^1H$ NMR (400 MHZ, $CDCl_3$) δ [ppm]=2.39-2.36 (m, 4H), 1.87-1.81 (m, 4H), 1.54-1.48 (m, 4H), 1.36-1.32 (m, 2H). The analytical data are in agreement with the literature values.

EXAMPLE 4

Preparation of Cyclodecanone:

In accordance with GP1, cyclodecane (0.701 g, 5.0 mmol, 1.0 equiv.) was dissolved in acetonitrile (25 mL) and subjected to galvanostatic electrolysis at 30° C. under an oxygen atmosphere with application of 5 F. The solvent was then removed by distillation under reduced pressure and the residue purified by column chromatography (CH/EA=10:0 to 9:1). After removal of the solvent by distillation and drying under reduced pressure, the product was obtained as a colourless liquid (yield: 12%, 90 mg, 0.59 mmol). Rf (cyclohexane/ethyl acetate=95:5): 0.28; $^1H$ NMR (300 MHZ, $CDCl_3$) δ [ppm]=2.49-2.45 (m, 4H), 1.85-1.76 (m, 4H), 1.47-1.43 (m, 4H), 1.32-1.29 (m, 6H). The analytical data are in agreement with the literature values. For the determination of the yield, any solvent signals present were deducted from the calculation via integral ratios.

EXAMPLE 5

Preparation of Cyclododecanone:

In accordance with GP1, cyclododecane (0.842 g, 5.0 mmol, 1.0 equiv.) was dissolved in isobutyronitrile (25 mL) and subjected to galvanostatic electrolysis at 27° C. under an oxygen atmosphere with application of 4 F. The solvent was then removed by distillation under reduced pressure and the residue purified by column chromatography (cyclohexane/ethyl acetate=10:0 to 9:1). After removal of the solvent by distillation and drying under reduced pressure, the product was obtained as a colourless solid (yield: 21%, 0.194 g, 1.06 mmol). Rf (cyclohexane/ethyl acetate=9:1): 0.48; $^1H$ NMR (400 MHZ, $CDCl_3$) δ [ppm]=2.47-2.44 (m, 4H), 1.72-1.69 (m, 4H), 1.31-1.26 (m, 14H). The analytical data are in agreement with the literature values.

EXAMPLE 6

In the experiments hereinbelow, various parameters of the electrochemical oxidation were varied in order to investigate their influence. These investigations were in each case carried out for the electrochemical oxidation of cyclooctane to cyclooooctanone.

General Procedure GP2a:

The electrolyses were carried out in an undivided 5 mL PTFE cell. For this, the cell was charged with the conducting salt (0.2 to 1.0 equiv.) and the substrate (cyclooctane, 0.5-2.5 mmol) and these were dissolved in the solvent (5 mL). The cell was furnished with a glassy carbon anode and glassy carbon cathode, which were 0.5 cm apart (electrode dimensions: 7 cm×1 cm×0.3 cm, immersed surface area 1.8 $cm^2$). The cells were fixed in a heatable/coolable stainless steel block and supplied via an adapter with the gas mixture under investigation (100% by volume $O_2$ to 0% by volume $O_2$). The electrolysis was carried out at constant current, with variation of the current densities (5-60 $mA/cm^2$), temperatures (5-50° C.), stirring speeds (100-600 rpm) and amounts of charge (4-8 F). After application of the amount of charge, 2 drops of the reaction solution were withdrawn for analysis by gas chromatography. 1,3,5-Trimethoxybenzene (1 equiv.) is then added to the solution as NMR standard and the solvent removed by distillation (45° C., 200 mbar). The yield of the cycloalkanone product was determined via 1H-NMR analysis.

For the GC analysis, 2 drops of the reaction solution were eluted with ethyl acetate through approx. 330 mg of silica gel 60 M. Approx. 1.5 mL of the filtrate was collected in a GC vial and investigated for oxidation products by GC-FID and GC-MS.

General Procedure GP2b:

The electrolyses were carried out in an undivided 5 mL PTFE cell. For this, the cell was charged with the conducting salt (0.2-1.0 equiv.) and the substrate (cyclooctane, 0.5-2.5 mmol) and these were dissolved in the solvent (5 mL). The cell was furnished with a glassy carbon anode and glassy carbon cathode, which were 0.5 cm apart (electrode dimensions: 7 cm×1 cm×0.3 cm, immersed surface area 1.8 $cm^2$). The cells were fixed in a heatable/coolable stainless steel block and supplied via an adapter with the gas mixture under investigation (100% by volume $O_2$ to 0% by volume $O_2$). The electrolysis was carried out at constant current, with variation of the current densities (5-60 $mA/cm^2$), temperatures (5-50° C.), stirring speeds (100-600 rpm) and amounts of charge (4-8 F). After application of the amount of charge, 10 mg of 1,3,5-trimethoxybenzene was added to the reaction solution as internal standard. 3 drops of the reaction solution were withdrawn for analysis by gas chromatography and quantification of the product. These were eluted with ethyl acetate through approx. 330 mg of silica gel 60 M. Approx. 1.5 mL of the filtrate was collected in a GC vial and investigated for oxidation products by GC-FID and GC-MS. Quantification was achieved via prior calibration of the gas chromatograph.

The results shown below in Scheme 1 were obtained using GP2a described above.

Scheme 1.

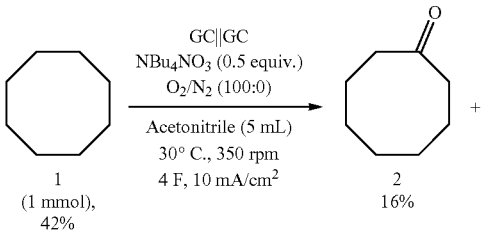

-continued

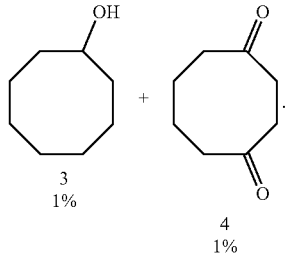

Further exemplary investigations are described below, grouped according to the parameters altered in each case:

Amount of charge (F in respect of cyclooctane 1)

Current density ($mA/cm^2$)

$O_2/N_2$ ratio

Equivalents (in respect of cyclooctane 1/nitrate salt)

Stirring speed (rpm)

Temperature (° C.)

Nitrate salt as mediator/conducting salt

Reaction medium

Electrode material

Varying the cation of the nitrate salts

The experiments were, unless otherwise stated, carried out at least twice and an average value with standard deviation determined. The reference numerals for compounds 1, 2, 3 and 4 correspond to the reference numerals in Scheme 1.

Example 6a—Amount of Charge

The amount of charge was investigated within a range of from 4 F to 8 F (corresponds to 386 C to 772 C for 1 mmol of substrate cyclooctane 1).

TABLE 1

Investigation of different amounts of charge

| Example No. | Amount of charge/F. | 1/% (GC int. 1:2) | 2/% ($^1$H NMR) | 3/% (GC int. 3:2) | 4/% (GC int. 4:2) |
|---|---|---|---|---|---|
| 6-GP2a-02 | 8 | 32 ± 7 | 15 ± 1 | 1 ± 0 | 1 ± 0 |
| 6-GP2a-03 | 6 | 32 ± 6 | 16 ± 2 | 1 ± 0 | 1 ± 0 |
| 6-GP2a-01 | 4 | 42 ± 8 | 16 ± 1 | 1 ± 0 | 1 ± 0 |

Const.: GC||GC, $NBu_4NO_3$ (0.5 equiv.), 1 (1 mmol), acetonitrile, 30° C., 350 rpm, 100% $O_2$ atm., 10 $mA/cm^2$.

In the investigated range for the amount of charge, no change in respect of product and by-product formation was observed. Because of the shorter electrolysis time, the test series was continued with 4 F.

Example 6b—Current Density

The current density was varied within the range 5 $mA/cm^2$ to 60 $mA/cm^2$.

The electrode surface area in the electrolyte solution was 1.8 $cm^2$.

TABLE 2

Investigation of different current densities.

| Example No. | Current density/ mA/cm$^2$ | 1/% (GC int. 1:2) | 2/% ($^1$H NMR) | 3/% (GC int. 3:2) | 4/% (GC int. 4:2) |
|---|---|---|---|---|---|
| 6-GP2a-04 | 60 | 54 ± 12 | 9 ± 0 | 8 ± 2 | 0 ± 0 |
| 6-GP2a-05 | 30 | 34 ± 11 | 18 ± 2 | 2 ± 1 | 1 ± 0 |
| 6-GP2a-06 | 20 | 48 ± 0 | 19 ± 1 | 1 ± 0 | 1 ± 0 |
| 6-GP2a-01 | 10 | 42 ± 8 | 16 ± 1 | 1 ± 0 | 1 ± 0 |
| 6-GP2a-07 | 5 | 35 ± 13 | 7 ± 0 | 1 ± 0 | 0 ± 0 |

Const.: GC||GC, $NBu_4NO_3$ (0.5 equiv.), 1 (1 mmol), acetonitrile, 30° C., 350 rpm, 100% $O_2$ atm., 4 F.

With application of 60 mA/cm$^2$, a clear decrease in the yield of 2 can be seen. Cyclooctanol 3 is instead formed to a comparable degree.

The test series was continued with 20 mA/cm$^2$ and different contents of atmospheric $O_2$ were investigated.

Example 6c—$O_2/N_2$ Ratio at 20 mA/cm$^2$

Rough $O_2/N_2$ ratios (100:0, 20:80, 0:100) at 20 mA/cm$^2$ were initially examined. The ratio 20:80 was chosen on account of its closeness to the composition of air.

TABLE 3

Investigation of different $O_2/N_2$ ratios at 20 mA/cm$^2$

| Example No. | $O_2/N_2$ ratio | 1/% (GC int. 1:2) | 2/% ($^1$H NMR) | 3/% (GC int. 3:2) | 4/% (GC int. 4:2) |
|---|---|---|---|---|---|
| 6-GP2a-06 | 100:0 | 48 ± 0 | 19 ± 1 | 1 ± 0 | 1 ± 0 |
| 6-GP2a-08 | 20:80 | 22 ± 2 | 5 ± 1 | 5 ± 0 | 0 ± 0 |
| 6-GP2a-09 | 0:100 | — | 0 ± 0 | Traces | — |

Const.: GC||GC, $NBu_4NO_3$ (0.5 equiv.), 1 (1 mmol), acetonitrile, 30° C., 350 rpm, 4 F., 20 mA/cm$^2$.

Under a pure nitrogen atmosphere (ratio 0:100), no product formation was observed. Therefore, no quantitative statements can be made about the unreacted substrate fraction or the by-products. In the gas chromatogram, traces of cyclooctanol 3 were however detected. In order to be able to relate the $O_2$ contents to the initial standard current density of 10 mA/cm$^2$, these were repeated at the stated current density with smaller gradations in content.

Example 6d—$O_2/N_2$ Ratio at 10 mA/Cm$^2$

In addition to the gradations in content shown in the table, experiments without the supply of gas were also carried out under ambient conditions (identified as "Air").

TABLE 4

Investigation of different $O_2/N_2$ ratios at 10 mA/cm$^2$

| Example No. | $O_2/N_2$ ratio | 1/% (GC int. 1:2) | 2/% ($^1$H NMR) | 3/% (GC int. 3:2) | 4/% (GC int. 4:2) |
|---|---|---|---|---|---|
| 6-GP2a-01 | 100:0 | 42 ± 8 | 16 ± 1 | 1 ± 0 | 1 ± 0 |
| 6-GP2a-10 | 50:50 | 35 ± 4 | 15 ± 3 | 1 ± 0 | 1 ± 0 |
| 6-GP2a-11 | 35:65 | 55 ± 3 | 9 ± 1 | 2 ± 0 | 0 ± 0 |
| 6-GP2a-12 | Air (approx. 21:78) | 27 ± 14 | 23 ± 5 | 2 ± 0 | 3 ± 1 |
| 6-GP2a-13 | 20:80 | 12 ± 4 | 31 ± 2 | 1 ± 0 | 6 ± 1 |
| 6-GP2a-14 | 10:90 | 29 ± 4 | 7 ± 0 | 3 ± 0 | 0 ± 0 |
| 6-GP2a-15 | 5:95 | 40 ± 8 | 6 ± 0 | 3 ± 0 | 0 ± 0 |

Const.: GC||GC, $NBu_4NO_3$ (0.5 equiv.), 1 (1 mmol), acetonitrile, 30° C., 350 rpm, 4 F., 10 mA/cm$^2$.

In the above investigations, the conversion of reactant 1, and formation of the product 2 were highest at an oxygen proportion of 20% by volume and a current density of 10 mA/cm$^2$. In addition, the formation of cyclooctanol 3 was slightly increased when the proportion of $O_2$ was low.

On account of the higher yield of cyclooctanone 2 and of the improvement in safety due to the higher proportion of nitrogen, these conditions were chosen as comparison conditions in subsequent reactions (Scheme 2) and the other parameters altered on the basis of these conditions.

Example 6e—Molar Amount and Equivalents of Mediator

To investigate different substrate and mediator concentrations in the solvent (acetonitrile, 5 mL), the molar amount of the substrate and the number of equivalents of conducting salt/mediator were varied.

TABLE 5

Investigation of different molar amounts and equivalents of nitrate

| Example No. | Molar amount (1)/mmol | Equivalents (1:$NO_3^-$) | 1/% (GC int. 1:2) | 2/% ($^1$H NMR) | 3/% (GC int. 3:2) | 4/% (GC int. 4:2) |
|---|---|---|---|---|---|---|
| 6-GP2a-16 | 0.5 | 1:0.5 | 21 ± 2 | 30 ± 1 | 2 ± 0 | 4 ± 0 |
| 6-GP2a-17 | 0.5 | 1:1.0 | 18 ± 2 | 30 ± 1 | 1 ± 0 | 6 ± 1 |
| 6-GP2a-18 | 1.0 | 1:0.2 | 20 ± 2 | 26 ± 2 | 2 ± 0 | 4 ± 1 |
| 6-GP2a-13 | 1.0 | 1:0.5 | 12 ± 4 | 31 ± 2 | 1 ± 0 | 6 ± 1 |
| 6-GP2a-19 | 1.0 | 1:1.0 | 10 ± 1 | 27 ± 1 | 1 ± 0 | 4 ± 1 |
| 6-GP2a-20 | 2.5 | 1:0.2 | 11 ± 3 | 23 ± 0 | 1 ± 0 | 4 ± 0 |
| 6-GP2a-21 | 2.5 | 1:0.5 | 11 ± 2 | 22 ± 0 | 1 ± 0 | 4 ± 0 |

Const.: GC||GC, $NBu_4NO_3$, acetonitrile, 30° C., 350 rpm, 20% $O_2$ atm., 4 F, 10 mA/cm$^2$.

In general, the conversion of the reactant 1 into the product 2 was slightly better at lower molar amounts of substrate (≤1 mmol, equivalent here to 0.2 mol/L) than at higher molar amounts. Varying the mediator concentration above or below 0.5 equivalents relative to the substrate resulted in only negligible differences in the yields of 2, so it can be assumed from this that the source of the oxygen for the oxo-functionalization is dissolved molecular oxygen.

Example 6f—Stirring Speed

Since the oxygen source for the ketone synthesis originates from the atmosphere, the stirring speed is expected to have a considerable influence on the course of the reaction.

TABLE 6

Investigation of different stirring speeds

| Example No. | Stirring speed/rpm | 1/% (GC int. 1:2) | 2/% ($^1$H NMR) | 3/% (GC int. 3:2) | 4/% (GC int. 4:2) |
|---|---|---|---|---|---|
| 6-GP2a-22 | 600 | 30 ± 1 | 7 ± 1 | 1 ± 0 | 0 ± 0 |
| 6-GP2a-23 | 500 | 26 ± 4 | 8 ± 0 | 2 ± 0 | 0 ± 0 |
| 6-GP2a-13 | 350 | 12 ± 4 | 31 ± 2 | 1 ± 0 | 6 ± 1 |
| 6-GP2a-24 | 200 | 28 ± 3 | 17 ± 1 | 2 ± 0 | 1 ± 0 |
| 6-GP2a-25 | 100 | 29 ± 4 | 8 ± 0 | 4 ± 0 | 0 ± 0 |

Const.: GC||GC, $NBu_4NO_3$ (0.5 equiv.), 1 (1 mmol), acetonitrile, 30° C., 20% $O_2$ atm., 4 F., 10 mA/cm$^2$.

The results in Table 6 show a maximum in the region of 350 rpm. However, the influence of the speed depends on the geometry of the stirrer and of the cell and should therefore not be regarded as a fixed value.

Example 6g—Temperature

The stated temperatures relate to heating block/cryostat temperatures. The electrolyte solutions were stirred at 5° C. and 50° C. for approximately half an hour before the start of the electrolysis.

TABLE 7

Investigation of different temperatures.

| Example No. | Temperature/ ° C. | 1/% (GC int. 1:2) | 2/% ($^1$H NMR) | 3/% (GC int. 3:2) | 4/% (GC int. 4:2) |
|---|---|---|---|---|---|
| 6-GP2a-26 | 50 | 9 ± 1 | 27 ± 2 | 1 ± 0 | 7 ± 1 |
| 6-GP2a-13 | 30 | 12 ± 4 | 31 ± 2 | 1 ± 0 | 6 ± 1 |
| 6-GP2a-27 | 5 | 17 ± 1 | 27 ± 2 | 1 ± 0 | 4 ± 1 |

Const.: GC||GC, $NBu_4NO_3$ (0.5 equiv.), 1 (1 mmol), acetonitrile, 350 rpm, 20% $O_2$ atm., 4 F., 10 mA/cm$^2$.

With regard to product formation, a minor decline in yield can be seen at temperatures higher and lower than 30° C. The reaction accordingly seems to be only slightly temperature-dependent. At higher temperatures a smaller fraction of unreacted substrate is moreover detected, which is presumably attributable to its volatility and to the open system of the electrolysis cells.

Example 6h—Conducting Salt/Mediator

To investigate whether nitrate as the anion of the conducting salt also has a mediator effect on the reaction, the standard tetrabutylammonium nitrate was compared with other common conducting salts. The cationic component was left unchanged here. The conducting salts differing from the standard were each tested in an electrolysis only once, which is why no average value was recorded here.

TABLE 8

Investigation of different conducting salts

| Example No. | Conducting salt | 1/% (GC int. 1:2) | 2/% ($^1$H NMR) | 3/% (GC int. 3:2) | 4/% (GC int. 4:2) |
|---|---|---|---|---|---|
| 6-GP2a-13 | $NBu_4NO_3$ | 12 ± 4 | 31 ± 2 | 1 ± 0 | 6 ± 1 |
| 6-GP2a-28 | $NBu_4BF_4$ | 57 | 3 | 2 | 1 |
| 6-GP2a-29 | $NBu_4PF_6$ | 50 | 3 | 2 | 1 |
| 6-GP2a-30 | $NBu_4ClO_4$ | 28 | 4 | 3 | 1 |

Const.: GC||GC, conducting salt (0.5 equiv.), 1 (1 mmol), acetonitrile, 30° C., 350 rpm, 20% $O_2$ atm., 4 F., 10 mA/cm$^2$.

The results in Table 8 illustrate the dependency of the reaction on the nitrate anion. The product 2 forms only to a very minor extent with different conducting salt anions.

Examples 6-GP2a-09, 6-GP2a-28, 6-GP2a-29 and 6-GP2a-30 are comparative examples.

Example 6i—Solvent

TABLE 9

Investigation of different solvents

| Example No. | Solvent (5 mL) | 1/% (GC int. 1:2) | 2/% ($^1$H NMR) | 3/% (GC int. 3:2) | 4/% (GC int. 4:2) |
|---|---|---|---|---|---|
| 6-GP2a-13 | Acetonitrile | 12 ± 4 | 31 ± 2 | 1 ± 0 | 6 ± 1 |
| 6-GP2a-31 | Isobutyronitrile | 23 ± 1 | 24 ± 1 | 1 ± 0 | 3 ± 0 |
| 6-GP2a-32 | Acetone | 41 ± 4 | 29 ± 1 | 2 ± 0 | 4 ± 1 |

Const.: GC||GC, $NBu_4NO_3$ (0.5 equiv.), 1 (1 mmol), 30° C., 350 rpm, 20% $O_2$ atm., 4 F., 10 mA/cm$^2$.

The reaction proceeded comparably well in the listed solvents. In acetone a higher proportion of unreacted substrate is moreover left behind.

The reaction was also carried out in 3-pentanone, but overlap of the solvent signals with the product signals meant it was not possible to determine the yield by $^1$H NMR. Analysis by gas chromatography did however confirm the selective formation of the product 2 in this case too.

Since an initial assumption had been that $O_2$ has better solubility in isobutyronitrile than in acetonitrile, a comparison under a 100% $O_2$ atmosphere was likewise made (Table 10).

TABLE 10

Investigation of different solvents at 100% by volume $O_2$.

| Example No. | Solvent (5 mL) | 1/% (GC int. 1:2) | 2/% ($^1$H NMR) | 3/% (GC int. 3:2) | 4/% (GC int. 4:2) |
|---|---|---|---|---|---|
| 6-GP2a-01 | Acetonitrile | 42 ± 8 | 16 ± 1 | 1 ± 0 | 1 ± 0 |
| 6-GP2a-33 | Isobutyronitrile | 58 ± 3 | 19 ± 2 | 1 ± 0 | 2 ± 0 |
| 6-GP2b-36 | Nitropropane | 30 | 17 | 2 | 2 |

Const.: GC||GC, $NBu_4NO_3$ (0.5 equiv.), 1 (1 mmol), 30° C., 350 rpm, 100% $O_2$ atm., 4 F., 10 mA/cm$^2$.

The results when using acetonitrile and isobutyronitrile are comparable. Specifically, a clear increase in the yield of 2 through the use of isobutyronitrile was not achieved. On the other hand, the proportion of unreacted 1 is significantly higher, which is considered an advantage. The reaction in nitropropane was subsequently carried out under a 100% $O_2$ atmosphere and confirms that nitrated alkanes may be used as solvent too.

Example 6j—Electrode Material

Electrolyses were carried out on different carbon-based electrode materials. The electrode materials differing from the GC standard were each tested in an electrolysis only once, which is why no average value was recorded here.

TABLE 11

Investigation of different electrode materials.

| Example No. | Anode ‖ cathode | 1/% (GC int. 1:2) | 2/% ($^1$H NMR) | 3/% (GC int. 3:2) | 4/% (GC int. 4:2) |
|---|---|---|---|---|---|
| 6-GP2a-13 | GC ‖ GC | 12 ± 4 | 31 ± 2 | 1 ± 0 | 6 ± 1 |
| 6-GP2a-34 | BDD ‖ BDD | 18 | 20 | 2 | 3 |
| 6-GP2a-35 | Graphite ‖ Graphite | 23 | 15 | 1 | 2 |

Const.: $NBu_4NO_3$ (0.5 equiv.), acetonitrile, 1 (1 mmol), 30° C., 350 rpm, 20% $O_2$ atm., 4 F., 10 mA/cm$^2$.

On all electrode materials used, the reaction took place and resulted in the formation of the product 2. On graphite electrodes, slight detachment of electrode material in the form of black particles is observed after the electrolysis, which is attributable to its lower stability.

Example 6k—Varying the Cation of the Conducting Salt/Mediator

Various cations other than the standard tetrabutylammonium were investigated. The following were used:

Hexadecyltrimethylammonium nitrate ($[C_{19}H_{42}N][NO_3]$)

1-Butyl-3-methylimidazolium nitrate ($[C_8H_{15}N_2][NO_3]$)

Methyltrioctylammonium nitrate ($[C_{25}H_{54}N][NO_3]$)

Tetrabutylphosphonium nitrate ($PBu_4NO_3$)

The anionic nitrate component was left unchanged here. The conducting salts differing from the standard were each tested in an electrolysis only once, which is why no average value was recorded here.

TABLE 12

Investigation of different cations.

| Example No. | Conducting salt | 1/% (GC int. 1:2) | 2/% (GC yield) | 3/% (GC int. 3:2) | 4/% (GC int. 4:2) |
|---|---|---|---|---|---|
| 6-GP2b-37 | $[C_{19}H_{42}N][NO_3]$ | 14 | 21 | 1 | 3 |
| 6-GP2b-38 | $[C_8H_{15}N_2][NO_3]$ | 0 | 17 | 0 | 8 |
| 6-GP2b-39 | $[C_{25}H_{54}N][NO_3]$ | 7 | 28 | 0 | 4 |
| 6-GP2b-40 | $PBu_4NO_3$ | 0 | 20 | 0 | 7 |

Const.: GC‖GC, conducting salt (0.5 equiv.), 1 (1 mmol), acetonitrile, 30° C., 350 rpm, 100% $O_2$ atm., 4 F., 10 mA/cm$^2$.

It can be seen that the oxidation of the cycloalkane to the ketone works primarily through the nitrate as anion component (cf. example 6h). Long-chain alkyl radicals on the ammonium cations result in slightly higher yields compared to the tetrabutylammonium cation under the same conditions. The reaction also works with N-alkylated nitrogen heteroaromatics as cations, and with tetraalkylphosphonium cations too.

Example 6l

Oxygen solubility in acetonitrile/$NBu_4NO_3$ at 25° C. and standard pressure:

TABLE 13

Dissolved oxygen concentration in MeCN/$NBu_4NO_3$ as a function of atmospheric oxygen content.

| Atm. (% by volume $O_2$) | c($O_2$)/(mmol/L) |
|---|---|
| Air | 2.4 ± 0.1 |
| 0 | 0.171 ± 0.004 |
| 5 | 1.16 ± 0.05 |
| 10 | 1.57 ± 0.07 |
| 20 | 2.5 ± 0.1 |
| 35 | 3.9 ± 0.2 |
| 50 | 5.1 ± 0.3 |
| 100 | 9.5 ± 0.4 |

General Procedure GP3:

The cycloalkane (5.0 mmol) and tetrabutylammonium nitrate (0.5 equiv.) were dissolved in acetonitrile (25 mL) in an undivided 25 ml beaker cell with gas-inlet attachment. The cell was equipped with glassy carbon electrodes (7 cm×1 cm×0.3 cm), which were 0.5 to 1.0 cm apart. The immersed surface area of the electrodes was 1.3 cm$^2$. A galvanostatic electrolysis was carried out at 20-30° C. at a current density of 10 mA/cm$^2$. After applying an amount of charge of 4 F in respect of the cycloalkane, the solvent together with the unreacted fraction of the cycloalkane was removed by distillation under reduced pressure. The residue was taken up in cyclohexane and water (20 mL each). After phase separation, the aqueous phase was extracted with cyclohexane (20 mL). The organic phases were combined, dried over sodium sulfate or magnesium sulfate, and the solvent was removed by distillation under reduced pressure. The product was left behind as the residue from this distillation.

Alternative quantification: After application of the amount of charge, approx. 50 mg of 1,3,5-trimethoxybenzene was added to the reaction solution as internal standard. 3 drops of the reaction solution were withdrawn for analysis by gas chromatography and quantification of the product. These were eluted with ethyl acetate through approx. 330 mg of silica gel 60 M. Approx. 1.5 mL of the filtrate was collected in a GC vial and investigated for oxidation products by GC-FID and GC-MS. Quantification was achieved via prior calibration of the gas chromatograph.

EXAMPLE 7

The influence of the distance between the electrodes was then investigated.

TABLE 14

Investigation of different distances between the electrodes.

| Example No. | Distance between electrodes [cm] | 1/%; (GC int. 1:2) | 2/% |
|---|---|---|---|
| 7-GP3-01 | 0.5 | No data | 31[a] |
| 7-GP3-02 | 1.0 | 49 | 16[b] |

Const.: GC‖GC, $NBu_4NO_3$ (0.5 equiv.), 1 (5 mmol), acetonitrile (25 mL), 20-30° C., 400 rpm, 100% $O_2$ atm., 4 F., 10 mA/cm$^2$.

[a]Isolated yield.

[b]GC yield.

From the examples in Table 14 it can be seen that the conversion of the starting material into the product 2 proceeds better when the distance between the electrodes is shorter.

The invention claimed is:

1. A process for producing unsubstituted or at least singly substituted cycloalkanones by electrochemical oxidation of at least one unsubstituted or an at least singly substituted, saturated cycloaliphatic hydrocarbon, the process comprising:

(a) providing the at least one unsubstituted or the at least singly substituted, saturated cycloaliphatic hydrocarbon;

(b) providing at least one organic nitrate salt; and (c) electrochemically oxidizing the at least one unsubstituted or the at least singly substituted, saturated cycloaliphatic hydrocarbon provided in (a) in the presence of the at least one organic nitrate salt provided in (b), in an electrolysis cell in a reaction medium in the presence of oxygen, wherein substituents of the at least singly substituted saturated cycloaliphatic hydrocarbon are each independently selected from the group consisting of: methyl, phenyl and benzyl substituents, wherein phenyl and benzyl may each be unsubstituted or singly or multiply substituted with 1, 2 or 3 substituents, each independently selected from the group consisting of: F, Cl, Br and $NO_2$.

2. The process according to claim 1, wherein the at least one unsubstituted or the at least singly substituted, saturated cycloaliphatic hydrocarbon is monocyclic or bicyclic.

3. The process according to claim 2, wherein the monocyclic or bicyclic saturated cycloaliphatic hydrocarbon has 5 to 18 carbon atoms in a ring system and is unsubstituted or singly or multiply substituted with 1, 2, 3, 4 or 5 multiple substituents.

4. The process according to claim 3, wherein the unsubstituted or the at least singly substituted, monocyclic or bicyclic saturated cycloaliphatic hydrocarbon is a monocyclic saturated hydrocarbon having 6 to 12 carbon atoms in the at least one ring system, wherein said monocyclic cycloaliphatic hydrocarbon is unsubstituted or singly or multiply substituted with 1, 2, 3, 4 or 5 substituents, each independently selected from the group consisting of methyl, phenyl and benzyl substituents.

5. The process according to claim 1, wherein the saturated cycloaliphatic hydrocarbon is unsubstituted and selected from the group consisting of: cyclohexane, cycloheptane, cyclooctane, cyclononane, cyclodecane, cycloundecane, and cyclododecane.

6. The process according to claim 1, wherein the at least one organic nitrate salt present is a nitrate of formula [cation+] [$NO_3$_], where [cation+] is selected from the group consisting of ammonium ions having structure [R1R2R3R4N+] where $R^1$, $R^2$, $R^3$, and $R^4$ are selected from; $C_1$ to $C_{16}$ alkyl, straight-chain or branched; imidazolium cations of formula (I)

(I)

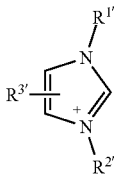

where $R^{1'}$ and $R^{2'}$ are selected from: of $C_1$ to $C_{18}$ alkyl; and $R^3$ is selected from the group consisting of: H and $C_1$ to $C_{18}$ alkyl, pyridinium cations of formula (II)

(II)

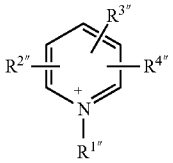

where $R^{1''}$ is selected from: $C_1$ to $C_{18}$ alkyl; and $R^{2''}$, $R^{3''}$ and $R^{4''}$ are each independently selected from the group consisting of: H and $C_1$ to $C_{18}$ alkyl, and phosphonium ions of structure [$R^{1a}R^{2a}R^{3a}R^{4a}P^+$] where $R^{1a}$, $R^{2a}$, $R^{3a}$ and $R^{4a}$ are selected from: $C_1$ to $C_{16}$ alkyl.

7. The process according to claim 6, wherein, in the imidazolium cations of formula (I), the radicals $R^{1'}$ and $R^{2'}$ are selected from: $C_1$ to $C_{18}$ alkyl, and $R^{3'}$ is hydrogen.

8. The process according to claim 6, wherein, in the pyridinium cations of formula (II), the radical $R^{1''}$ is $C_1$ to $C_{18}$ alkyl, and theradicals $R^{2''}$, $R^{3''}$ and $R^{4''}$ are selected from: $C_1$ to $C_8$ alkyl.

9. The process according to claim 6, wherein the at least one organic nitrate salt is selected from the group consisting of: tetra-n-butylammonium nitrate, methyltri-n-octylammonium nitrate, tetra-n-butylphosphonium nitrate, methyltri-n-octylphosphonium nitrate, and 1-butyl-3-methylimidazolium nitrate.

10. The process according to claim 1, wherein the at least one unsubstituted or the at least singly substituted, saturated cycloaliphatic hydrocarbon or an inorganic nitrate salt or the at least one organic nitrate salt is initially charged and brought together with the reaction medium, and then other components are added to these two components.

11. The process according to claim 1, wherein the at least one unsubstituted or the at least singly substituted, saturated cycloaliphatic hydrocarbon and an inorganic nitrate salt or the at least one organic nitrate salt are initially charged and then brought together with the reaction medium and at least partially or completely dissolved in the reaction medium or mixed therewith.

12. The process according to claim 1, wherein the at least one unsubstituted or the at least singly substituted, saturated cycloaliphatic hydrocarbon and an inorganic nitrate salt or the at least one organic nitrate salt are added to the reaction medium at the same time or one after the other and at least partially or completely dissolved in the reaction medium or mixed therewith.

13. The process according to claim 1, wherein the reaction medium is a polar aprotic reaction medium, which is present in an anhydrous or dried form or optionally in combination with water, wherein the polar aprotic reaction medium is selected from the group consisting of aliphatic nitriles, aliphatic ketones, cycloaliphatic ketones, dialkyl carbonates, cyclic carbonates, lactones, aliphatic nitroalkanes, dimethyl sulfoxide, esters, ethers, and mixtures of at least two of these components.

14. The process according to claim 13, wherein the polar aprotic reaction medium is selected from the group consisting of acetonitrile, isobutyronitrile, adiponitrile, acetone, dimethyl carbonate, methyl ethyl ketone, 3-pentanone, cyclohexanone, nitromethane, nitropropane, tert-butyl methyl ether, dimethyl sulfoxide, gamma-butyrolactone, epsilon-caprolactone, and mixtures of at least two of these components, in each case optionally in combination with the water as the reaction medium.

15. The process according to claim 13, wherein the polar aprotic reaction medium is selected from the group consisting of acetonitrile, isobutyronitrile, adiponitrile, dimethyl carbonate, acetone, and mixtures of at least two of these components, optionally in combination with the water.

16. The process according to claim 15, wherein the polar aprotic reaction medium is acetonitrile, isobutyronitrile or adiponitrile in dried or anhydrous form.

17. The process according to claim 1, wherein the reaction medium comprises one or more solubilizing components.

18. The process according to Claim claim 17, wherein primary alcohols, secondary alcohols, monoketones or dialkyl carbonates or mixtures of at least two of these components, optionally in combination with water, are present as the one or more solubilizing components.

19. The process according to claim 17, wherein aliphatic $C_{1-6}$ alcohols are present as the one or more solubilizing components, optionally in combination with water.

20. The process according to claim 17, wherein the one or more solubilizing components are added in an amount of <50% by volume, based on a total amount of the reaction medium present.

21. The process according to claim 1, wherein dimethyl carbonate is present as the reaction medium, optionally in combination with at least one $C_{1-6}$ alcohol.

22. The process according to claim 21, wherein the reaction medium comprises water.

23. The process according to claim 1, wherein the at least one organic nitrate salt is used in an amount of 0.1 to 2.0 equivalents, based on an amount of the at least one unsubstituted or the at least singly substituted, saturated cycloaliphatic hydrocarbon used.

24. The process according to claim 1, wherein an oxygen-containing gas atmosphere providing the oxygen is in spatial communication with the reaction medium.

25. The process according to claim 24, wherein gas exchange is forced between the oxygen-containing gas atmosphere and the reaction medium by introducing the oxygen-containing gas atmosphere into the reaction medium, or by stirring the reaction medium in the presence of the oxygen-containing gas atmosphere.

26. The process according to claim 24, wherein the oxygen-containing gas atmosphere is air.

27. The process according to claim 24, wherein gas exchange is forced between the oxygen-containing gas atmosphere and the reaction medium.

28. The process according to claim 27, wherein the gas exchange is effected by introducing the oxygen-containing gas atmosphere into the reaction medium.

29. The process according to claim 27, wherein the gas exchange is effected by stirring a liquid phase of the reaction medium in the presence of the oxygen-containing gas atmosphere.

30. The process according to claim 29, wherein the stirring is used to control the electrochemical oxidation.

31. The process according to claim 1, wherein an amount of the oxygen dissolved in the reaction medium is at least 1 mmol/L of the reaction medium.

32. The process according to claim 1, wherein the electrolysis cell is an undivided electrolysis cell.

33. The process according to claim 32, wherein the undivided electrolysis cell has a glassy carbon anode, a graphite anode, or a boron-doped diamond (BDD) anode.

34. The process according to claim 32, wherein the undivided electrolysis cell has a glassy carbon cathode, a graphite cathode, or a boron-doped diamond (BDD) cathode.

35. The process according to claim 1, wherein a distance between electrodes in the electrolysis cell is 0.1 mm to 2.0 cm.

36. The process according to claim 1, wherein an amount of charge is at least 190 C (2 F) to 970 C (10 F per 1 mmol of the at least one unsubstituted or the at least singly substituted, saturated cycloaliphatic hydrocarbon.

37. The process according to claim 1, wherein a current density is at least 5 $mA/cm^2$, where a stated surface area refers to a geometric area of electrodes of the electrolysis cell.

38. The process according to Claim claim 1, wherein a current density is at least 20 $mA/cm^2$ to 50 $mA/cm^2$, where a stated surface area refers to a geometric area of electrodes of the electrolysis cell.

39. The process according to claim 1, wherein said process comprising the electrolysis cell is carried out in an undivided cell.

40. The process according to claim 1, wherein a current used for the electrochemical oxidation comes from a renewable source.

41. The process according to claim 1, wherein the electrochemical oxidation takes place at a temperature within a range of from 0 to 60° C.

42. The process according to claim 1, wherein the electrochemical oxidation is carried out under atmospheric pressure.

43. The process according to claim 1, wherein the electrochemical oxidation is carried out under reduced pressure.

44. The process according to claim 1, wherein the electrochemical oxidation is carried out under elevated pressure.

45. The process according to claim 1, wherein the electrochemical oxidation is carried out batchwise.

46. The process according to claim 1, wherein the electrochemical oxidation is carried out continuously.

47. The process according to claim 1, wherein the electrochemical oxidation is carried out without addition of a catalyst.

48. The process according to claim 1, wherein no further oxidants besides the oxygen or oxygen in air are added.

* * * * *